US010747163B2

(12) United States Patent
Kawajiri

(10) Patent No.: US 10,747,163 B2
(45) Date of Patent: Aug. 18, 2020

(54) PRINTING APPARATUS, METHOD FOR CONTROLLING SAME, AND STORAGE MEDIUM

(71) Applicant: CANON KABUSHIKI KAISHA, Tokyo (JP)

(72) Inventor: Kensuke Kawajiri, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/421,583

(22) Filed: May 24, 2019

(65) Prior Publication Data

US 2020/0117132 A1 Apr. 16, 2020

(30) Foreign Application Priority Data

Oct. 15, 2018 (JP) ..... 2018-194457

(51) Int. Cl.
*G03G 15/00* (2006.01)

(52) U.S. Cl.
CPC ..... *G03G 15/80* (2013.01); *G03G 15/5004* (2013.01)

(58) Field of Classification Search
CPC ..... G03G 15/80; G03G 15/5004
See application file for complete search history.

(56) References Cited

U.S. PATENT DOCUMENTS

2015/0153702 A1* 6/2015 Yamamizu ..... G03G 15/5004 399/88

FOREIGN PATENT DOCUMENTS

JP H08069225 A 3/1996

* cited by examiner

*Primary Examiner* — Hoang X Ngo
(74) *Attorney, Agent, or Firm* — Rossi, Kimms & McDowell LLP

(57) ABSTRACT

The present invention provides a printing apparatus including a standby state and a power saving state in which power consumption is lower than in the standby state, the printing apparatus comprising: a control unit that integrally controls the apparatus; a plurality of engines for providing functions of the apparatus; and a power source control unit that controls power supply to the control unit and the plurality of engines in accordance with the standby state and the power saving state, wherein, when the apparatus is caused to transition to the standby state from the power saving state, the power source control unit controls power in the standby state after it is confirmed that the plurality of engines can return to the standby state.

22 Claims, 9 Drawing Sheets

PRINTING APPARATUS, METHOD FOR CONTROLLING SAME, AND STORAGE MEDIUM

BACKGROUND OF THE INVENTION

Field of the Invention

The present invention relates to a printing apparatus, a method for controlling the same, and a storage medium.

Description of the Related Art

Conventionally, in order to realize power saving in printing apparatuses and the like, such apparatuses maintain, as an operation mode, a sleep state in which power supply to a portion that is not in use is stopped. It is commonly known that display units such as a touch panel and an LED key are turned off in the sleep state, and when pressing of a touch panel or a key is detected and an apparatus returns to the standby state, for example, the display units such as the touch panel and the LED key are turned on.

Japanese Patent Laid-Open No. 08-069225 proposes a facsimile apparatus that stops operations of an LCD and turns on a tally lamp so that a user can understand that the main power source is turned on/off, when the apparatus transitions to the sleep state in which the copy function is off.

However, the above-described conventional technique has the issues described below. For example, in the case of power saving control as the above-described conventional technique, if internal modules of a printing apparatus can return to the standby state from the sleep state under different conditions, some keys cannot be used even if an LED or the like is turned on. For example, the printing apparatus is constituted by a control unit (system controller) and engines such as a printer, a scanner, and a facsimile. Although the control unit can return to the standby state from the sleep state without any restrictions at this time, the printer has restrictions in that the printer can return to the standby state only after 7 seconds have elapsed from when the printer transitioned to the sleep state (more specifically, from when an instruction to transition to the sleep state was issued), for example. In such a case, although operations such as changing of settings using only the control unit can be performed within 7 seconds from transitioning to the sleep state, a copy operation and the like using the scanner and the printer cannot be performed. Thus, if all of the display units such as the touch panel and the LED key are turned on in accordance with the power state of the control unit, a currently unavailable key is presented to a user as if this key can be used, and the usability decreases.

SUMMARY OF THE INVENTION

The present invention enables realization of a user interface that suitably indicates unfeasible operations even if a system controller and an engine return from the sleep state under different conditions.

One aspect of the present invention provides a printing apparatus including a standby state and a power saving state in which power consumption is lower than in the standby state, the printing apparatus comprising: a control unit that integrally controls the apparatus; a plurality of engines for providing functions of the apparatus; and a power source control unit that controls power supply to the control unit and the plurality of engines in accordance with the standby state and the power saving state, wherein, when the apparatus is caused to transition to the standby state from the power saving state, the power source control unit controls power in the standby state after it is confirmed that the plurality of engines can return to the standby state.

Another aspect of the present invention provides a method for controlling a printing apparatus including a standby state and a power saving state in which power consumption is lower than in the standby state, the printing apparatus including a control unit that integrally controls the apparatus, a plurality of engines for providing functions of the apparatus, and a power source control unit that controls power supply to the control unit and the plurality of engines in accordance with the standby state and the power saving state, the method comprising: controlling, when the apparatus is caused to transition to the standby state from the power saving state, power in the standby state after it is confirmed that the plurality of engines can return to the standby state.

Still another aspect of the present invention provides a non-transitory storage medium for causing a computer to execute control in a method for controlling a printing apparatus including a standby state and a power saving state in which power consumption is lower than in the standby state, the printing apparatus including a control unit that integrally controls the apparatus, a plurality of engines for providing functions of the apparatus, and a power source control unit that controls power supply to the control unit and the plurality of engines in accordance with the standby state and the power saving state, wherein the control method includes controlling, when the apparatus is caused to transition to the standby state from the power saving state, power in the standby state after it is confirmed that the plurality of engines can return to the standby state.

Further features of the present invention will be apparent from the following description of exemplary embodiments with reference to the attached drawings.

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

Note that a multi function peripheral (a digital multi function peripheral/MFP) will be described as an example of a printing apparatus according to an embodiment. However, the present invention can be applied to an electrophotographic printing apparatus such as a laser printer and a FAX machine within the scope of the present invention. Also, an object to which the present invention is applied need not be limited to a printing apparatus, and the present invention can also be applied to an information processing apparatus that does not have an image forming function or an image processing function.

Configuration of Image Forming Apparatus (Printing Apparatus)

Figure 1:
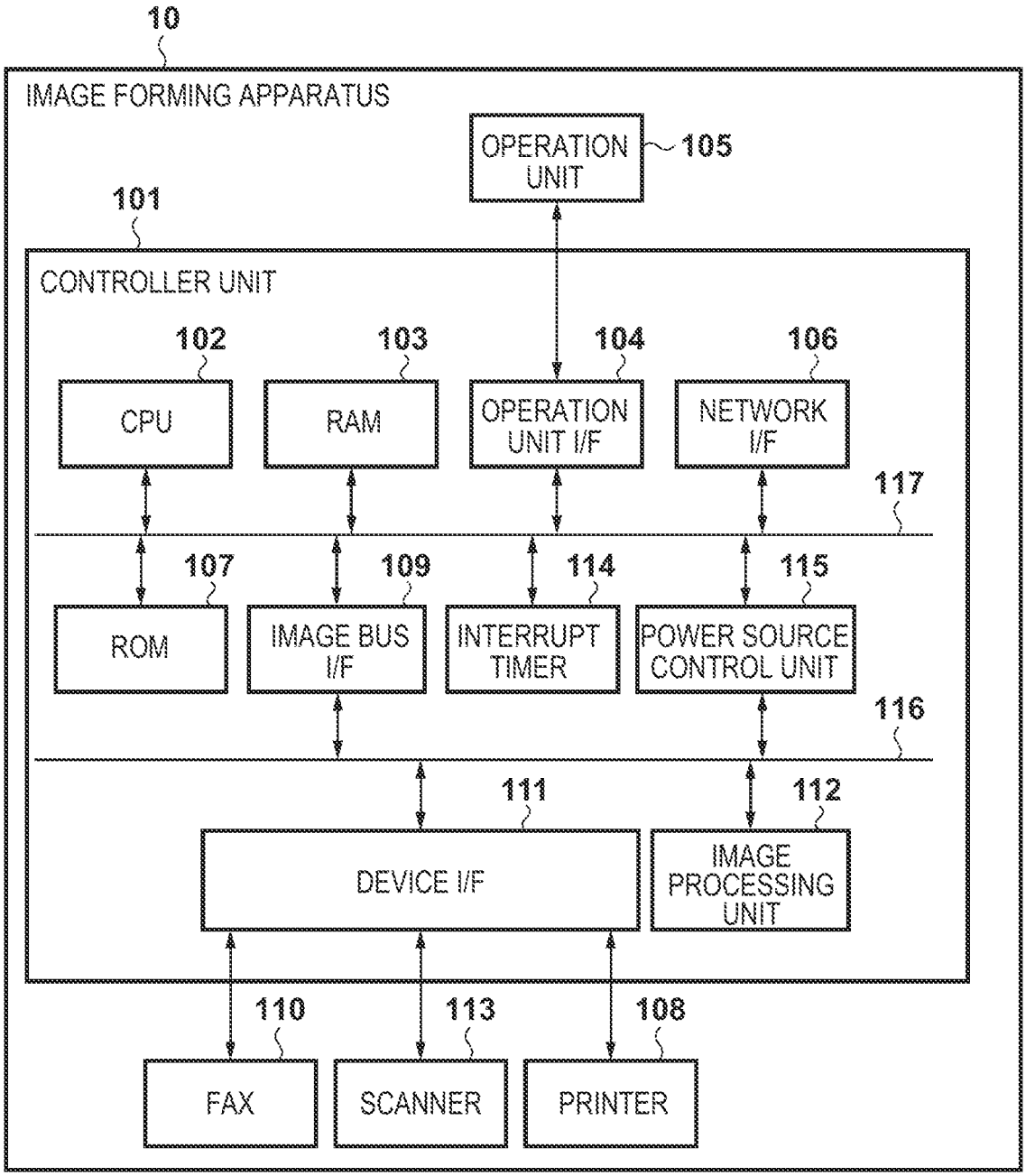
FIG. 1 is a block diagram showing a control configuration of an image forming apparatus according to one embodiment.

Hereinafter, one embodiment of the present invention will be described with reference to the attached drawings. First, a hardware configuration of an image forming apparatus (printing apparatus) 10 according to one embodiment will be described with reference to FIG. 1.

The image forming apparatus 10 includes various engines such as a printer 108, a facsimile 110, and a scanner 113, in addition to a control unit 101 and an operation unit 105. The control unit 101 includes a CPU 102, a RAM 103, an operation unit I/F 104, a network I/F 106, a ROM 107, an image bus I/F 109, an interrupt timer 114, and a power source control unit 115 that are connected to each other via a system bus 117. Furthermore, the control unit 101 includes a device I/F and an image processing unit 112 that are connected to each other via an image bus 116. Note that the image bus I/F 109 and the power source control unit 115 are also connected to the image bus 116. Also, the control unit 101 is connected to the scanner 113, the printer 108, and the facsimile 110. The scanner 113 is an image input device that reads an image such as a document and inputs image data. The printer 108 is an image output device that outputs image data output from the control unit 101. The facsimile 110 transmits and receives facsimile images.

The CPU 102 integrally controls the entire control unit 101. The RAM 103 is a system work memory for operations of the CPU 102, and is an image memory for temporarily storing image data. The ROM 107 is a boot ROM, and a boot program of the system is stored in the ROM 107. The power source control unit 115 supplies power required for operations of units in the image forming apparatus 10, and is controlled by the CPU 102. The interrupt timer 114 causes timer interruption at a time designated by the CPU 102, and notifies the power source control unit 115 of the timer interruption. The operation unit I/F 104 is an interface unit with the operation unit 105, and outputs image data to be displayed on the operation unit 105 to the operation unit 105. Also, the operation unit I/F 104 has the function of transmitting information input by a user from the operation unit 105 to the CPU 102. The network I/F 106 is connected to a network, and receives and outputs information from/to an external apparatus.

The image bus I/F 109 is a bus bridge for converting a data structure, and is connected to the system bus 117 and the image bus 116 that transfers image data at high speed. The image bus 116 is constituted by a PCI bus or IEEE 1394. The device I/F 111 and devices of the image processing unit 112 are disposed on the image bus 116. The device I/F 111 connects the scanner 113, the printer 108, the facsimile 110, and the control unit 101. The image processing unit 112 executes image processing for correcting, processing, and editing image data. Note that, although a configuration including the scanner 113, the printer 108, and the facsimile 110 as a plurality of engines for providing the functions of the printing apparatus is described in the present embodiment, this is not intended to limit the present invention. For example, it is sufficient that at least one of these engines is included, or another engine may be included.

Power Supply Circuit

Figure 2:
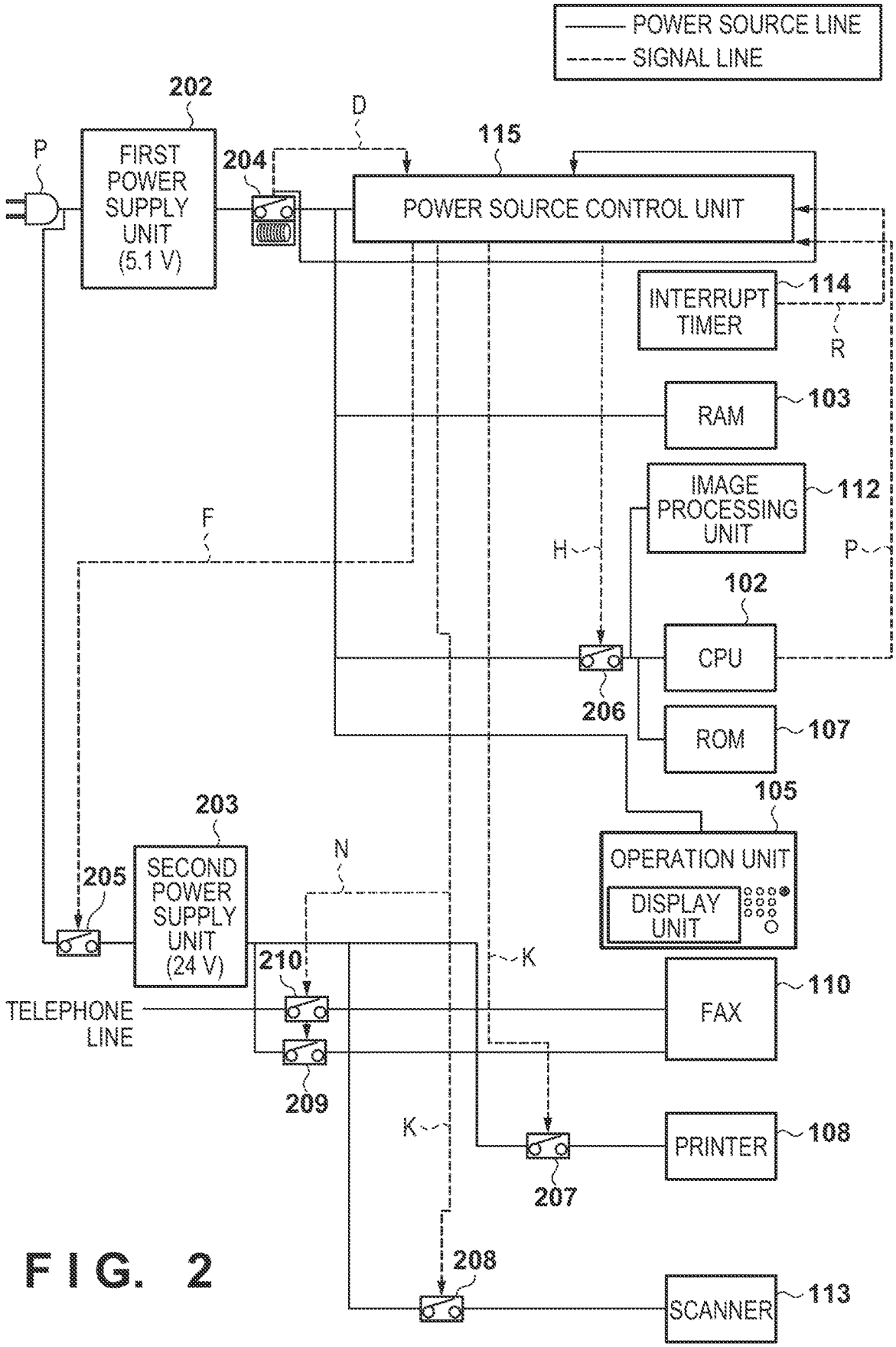
FIG. 2 is a block diagram showing a power supply circuit diagram of an image forming apparatus according to one embodiment.

Next, a configuration of a power supply circuit of the image forming apparatus 10 according to the present embodiment will be described with reference to FIG. 2. Note that a power supply state is not shown in FIG. 2.

A first power supply unit 202 converts alternating-current power supplied via a plug P to direct-current power (for example, 5.1 V (first output power)) and outputs the direct-current power. The direct-current power output from the first power supply unit 202 is supplied to devices (the power source control unit 115, the CPU 102, the RAM 103, the ROM 107, the operation unit 105, and the image processing unit 112) in a first power source system. The interrupt timer 114 is configured to be driven using a battery, and does not require power supply from the outside. A second power supply unit 203 converts alternating-current power supplied via the plug P to direct-current power (for example, 24 V) and outputs the direct-current power. The direct-current power output from the second power supply unit 203 is supplied to devices (the printer 108, the scanner 113, and the facsimile 110) in a second power source system. Power can also be supplied from a telephone line to the facsimile 110, and in this case, it is not necessary to supply power from the second power supply unit 203 to the facsimile 110.

Also, a power source switch 204 that is turned ON or OFF depending on a user operation is provided between the first power supply unit 202 and devices in the first power source system. A signal D indicating the state (ON state or OFF state) of the power source switch 204 is input to the power source control unit 115. On the other hand, a relay switch 205 is provided between the plug P and the second power supply unit 203. The relay switch 205 is switched from the ON state to the OFF state, or from the OFF state to the ON state, according to a control signal F output from the power source control unit 115.

A switch 206 is provided between the power source switch 204 and the CPU 102, ROM 107, and the image processing unit 112. The switch 206 is switched from the ON state to the OFF state, or from the OFF state to the ON state, according to a control signal H output from the power source control unit 115. A switch 207 is provided between the second power supply unit 203 and the printer 108.

A switch 208 is provided between the second power supply unit 203 and the scanner 113. These switches 207 and 208 are switched from the ON state to the OFF state, or from the OFF state to the ON state, according to a control signal K output from the power source control unit 115. A switch 209 is provided between the second power supply unit 203 and the facsimile 110. A switch 210 is provided between a power supply unit of an external telephone line and the facsimile 110. These switches 209 and 210 are switched from the ON state to the OFF state, or from the OFF state to the ON state, according to a control signal N output from the power source control unit 115.

Power Supply State when Power Source is OFF

Figure 3:
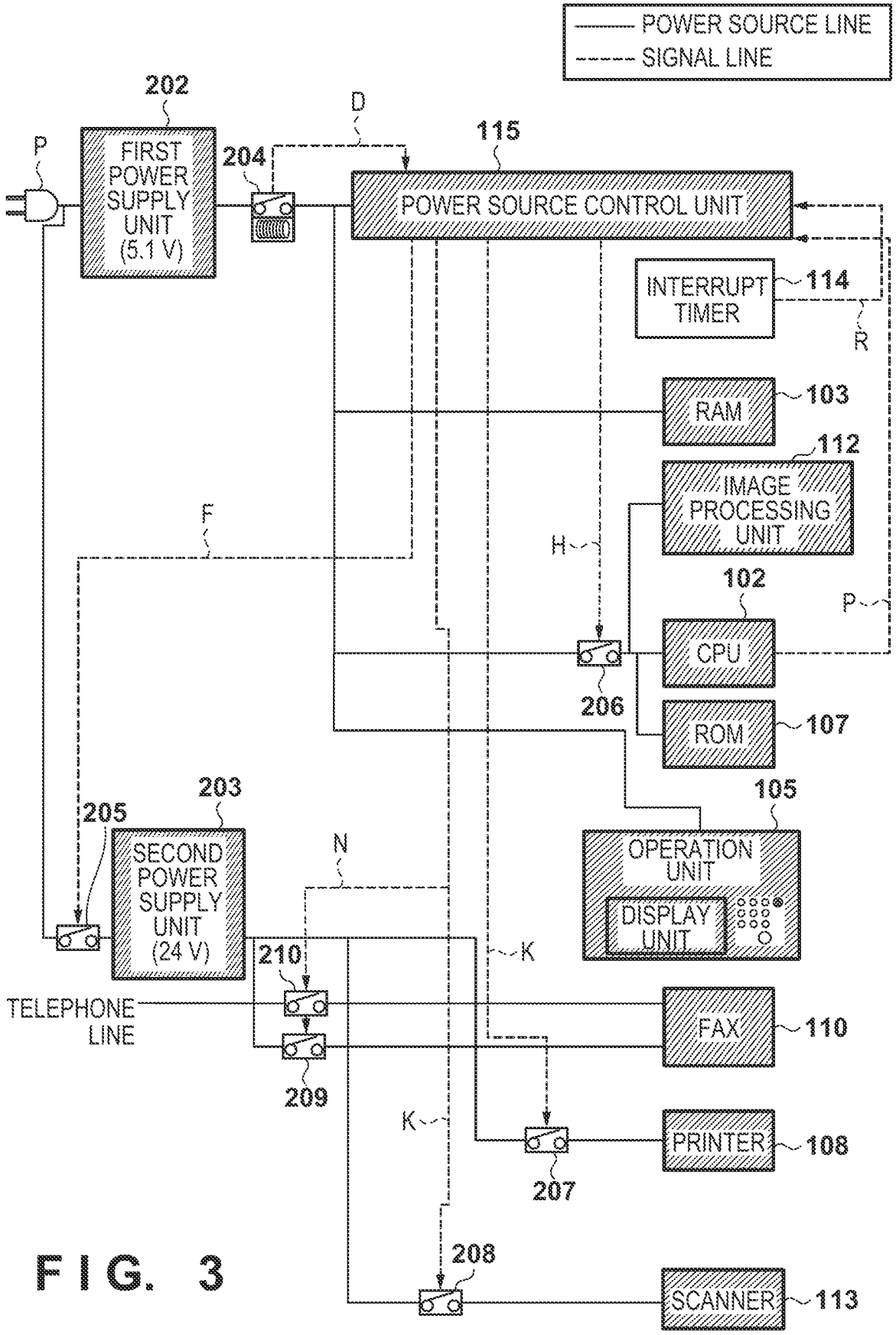
FIG. 3 is a diagram showing a power supply state when a power source of an image forming apparatus according to one embodiment is OFF.

Next, a power supply state when the power source of the image forming apparatus 10 is OFF will be described with reference to FIG. 3. Hatched blocks are blocks in a state in which power is not supplied (non-power supply state). On the other hand, unhatched blocks are blocks in a state in which power is supplied (power supply state). Note that the same applies to the following drawings.

When the power source is OFF, each of the switches 204 to 210 is OFF. Thus, power is supplied to each load, and power is supplied only to the interrupt timer 114 that is driven using a battery.

Power Supply State in Second Sleep State

Figure 4:
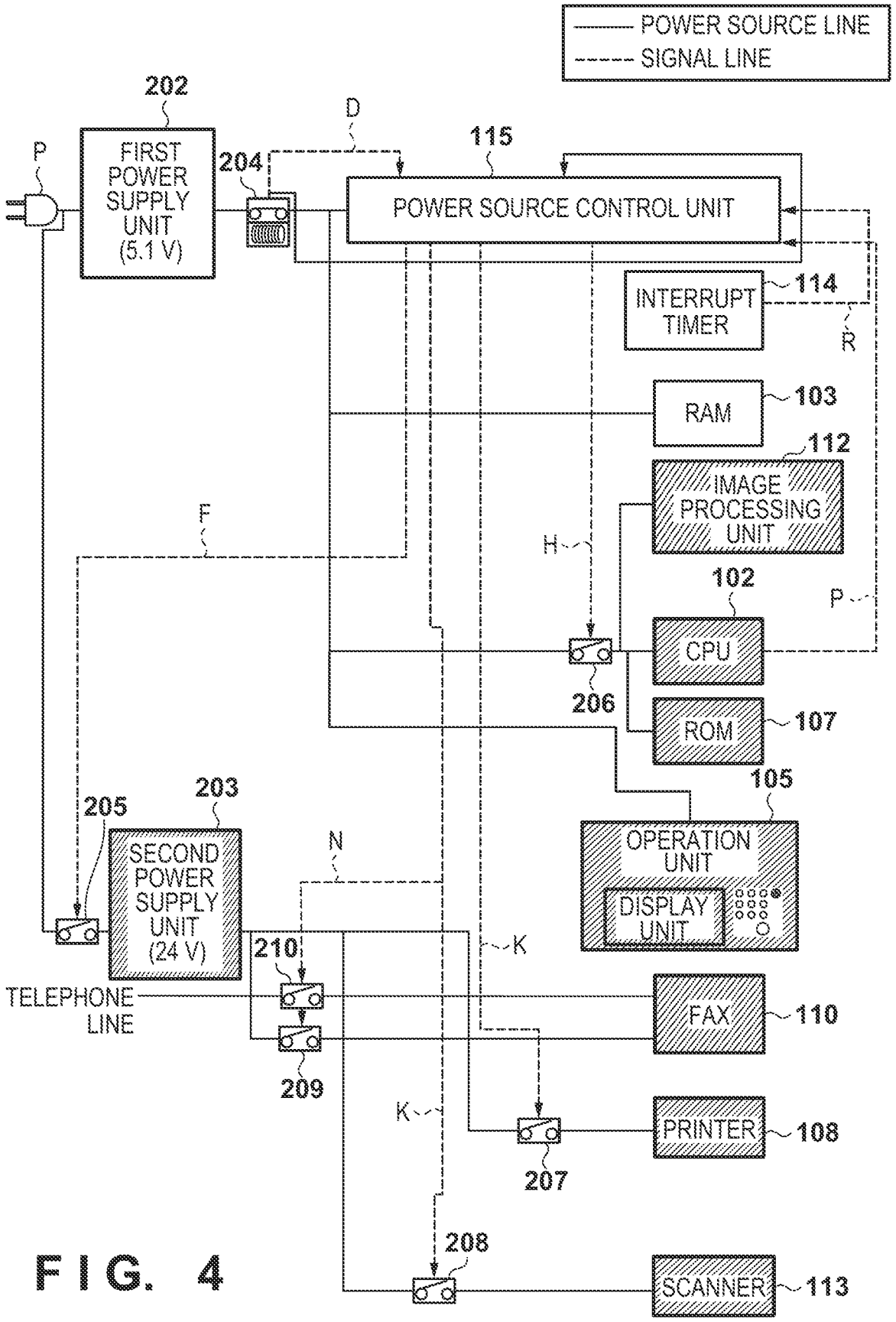
FIG. 4 is a diagram showing a power supply state when an image forming apparatus according to one embodiment is in a second sleep state.

Next, a power supply state when the image forming apparatus 10 is in a second sleep state will be described with reference to FIG. 4. In the second sleep state, a load of supplying power is smaller than in the first sleep state, and power consumption is further reduced. Note that the first sleep state and the second sleep state are referred to as a "power saving state" hereinafter. In the second sleep state, the switch 204 is ON, and the other switches are OFF. Thus, direct-current power output from the first power supply unit 202 is supplied to the power source control unit 115 and the RAM 103, and power output from the battery is supplied to the interrupt timer 114. The other loads are in the non-power supply state.

When the image forming apparatus 10 transitions to the second sleep state, the CPU 102 sets an interrupt time period in the interrupt timer 114. Once the set interrupt time period has elapsed (has expired), the interrupt timer 114 performs an interrupt notification to the power source control unit 115 using the control signal R. When the power source control unit 115 receives the interrupt notification of the control signal R, the power source control unit 115 performs control to transition to the first sleep state. Accordingly, the image forming apparatus 10 periodically transitions to the first sleep state from the second sleep state.

Power Supply State in First Sleep State

Figure 5:
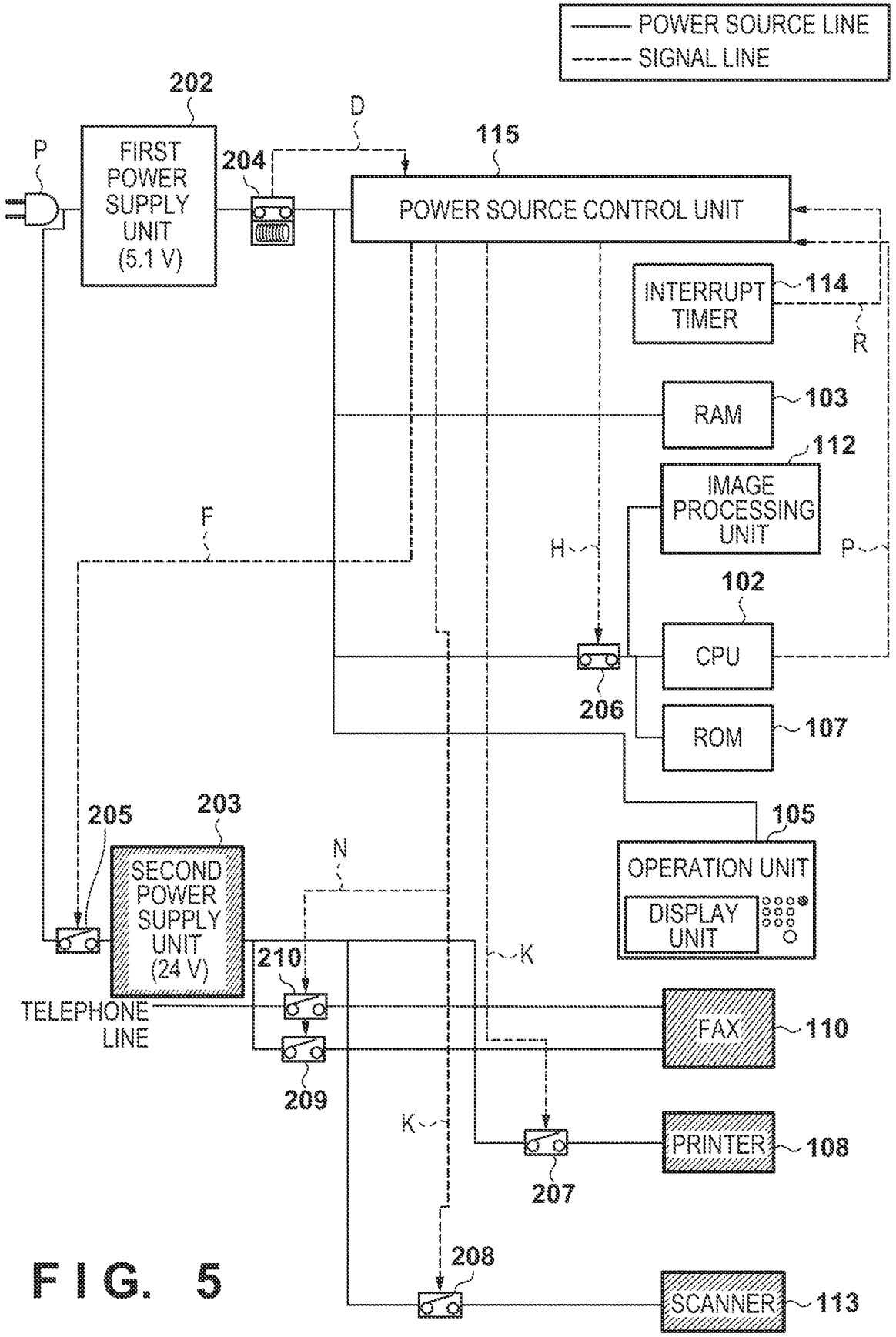
FIG. 5 is a diagram showing a power supply state when an image forming apparatus according to one embodiment is in a first sleep state.

Next, a power supply state when the image forming apparatus 10 is in the first sleep state will be described with reference to FIG. 5. In the first sleep state, the switches 204 and 206 are ON, and the other switches are OFF. Thus, a direct current output from the first power supply unit 202 is supplied to the power source control unit 115, the RAM 103, the image processing unit 112, the CPU 102, and the ROM 107, and the operation unit 105, and power output from the battery is supplied to the interrupt timer 114.

If no input is made from the operation unit I/F 104 and the network I/F 106 for a certain time period after the image forming apparatus 10 has transitioned to the first sleep state, the CPU 102 notifies the power source control unit 115 to transition to the second sleep state using the control signal P. When the power source control unit 115 is notified by the control signal P to transition to the second sleep state, the power source control unit 115 performs control to transition to the second sleep state. When the CPU 102 accepts an input from the operation unit I/F 104 and the network I/F 106 in the first sleep state, the CPU 102 notifies the power source control unit 115 to transition to the standby state using the control signal P. When the power source control unit 115 is notified by the control signal P to transition to the standby state, the power source control unit 115 performs control to transition to the standby state. The flow of this control will be described in detail with reference to FIG. 9.

Power Supply State During Standby

Figure 6:
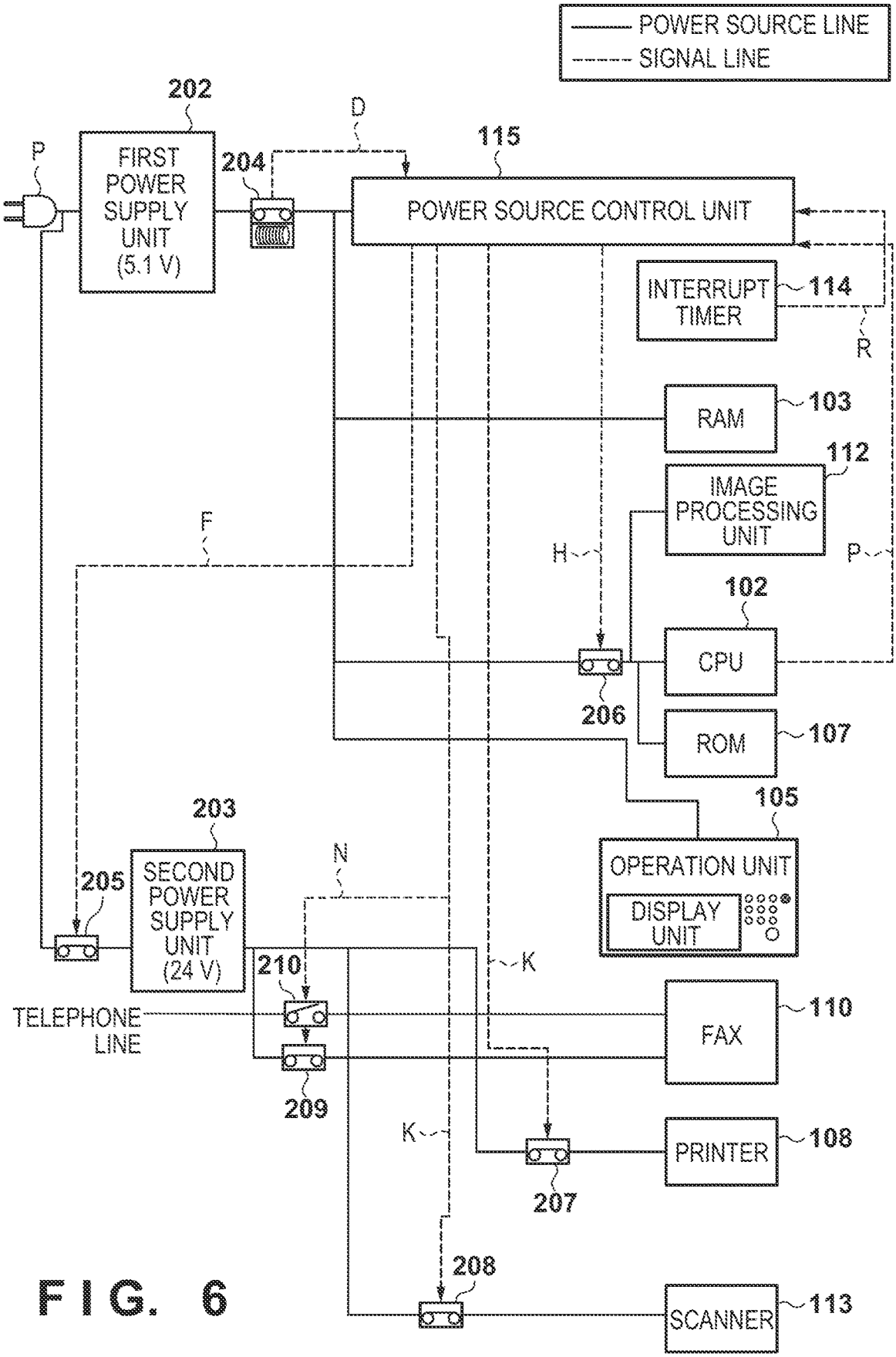
FIG. 6 is a diagram showing a power supply state when an image forming apparatus according to one embodiment is on standby.

Next, a power supply state when the image forming apparatus 10 is on standby will be described with reference to FIG. 6. In the standby state, the switches 204 to 210 are ON. Thus, a direct current output from the first power supply unit 202 is supplied to the power source control unit 115, the RAM 103, the image processing unit 112, the CPU 102, and the ROM 107, and the operation unit 105, and power output from the battery is supplied to the interrupt timer 114. Also, a direct current output from the second power supply unit 203 is supplied to the facsimile 110, the printer 108, and the scanner 113.

If no input is made from the operation unit I/F 104 and the network I/F 106 for a certain time period after the image forming apparatus 10 has transitioned to the standby state, the CPU 102 notifies the power source control unit 115 to transition to the first sleep state using the control signal P. When the power source control unit 115 is notified by the control signal P to transition to the first sleep state, the power source control unit 115 performs control to transition to the first sleep state. The flow of this control will be described in detail with reference to FIG. 8.

Operation Unit

Figure 7:
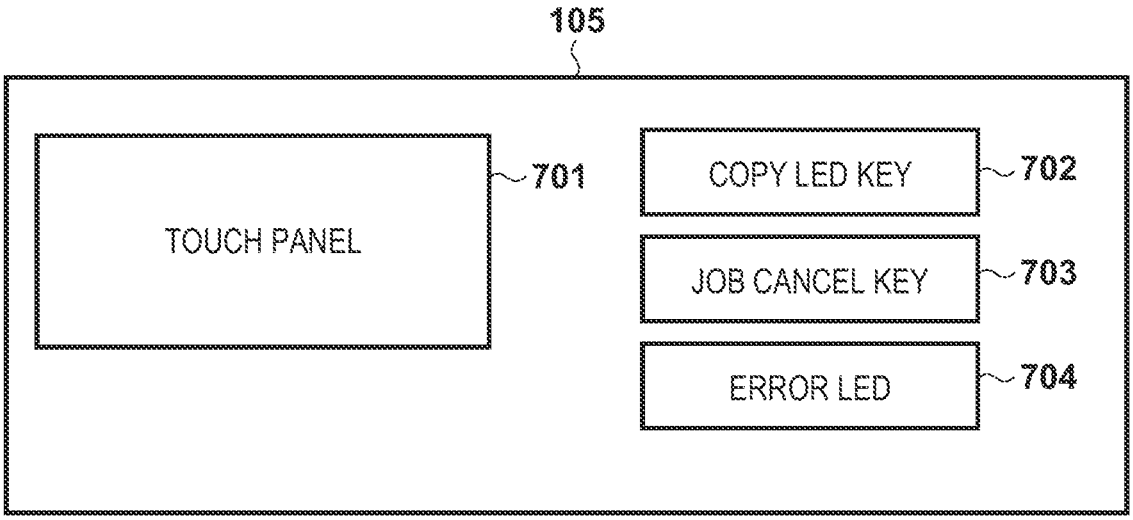
FIG. 7 is a diagram showing an operation unit of an image forming apparatus according to one embodiment.

Next, the operation unit 105 according to the present embodiment will be described in detail with reference to FIG. 7. The operation unit 105 is controlled by the CPU 102. The operation unit 105 is provided with a touch panel 701, a copy LED key 702, a job cancel key 703, and an error LED 704.

The touch panel 701 is a display device configured to accept user operations regarding displaying, settings, and operations regarding the image forming apparatus 10. Although a user essentially operates the image forming apparatus 10 using the touch panel 701, the copy LED key 702, the job cancel key 703, and the error LED 704 dedicated to specific functions are provided in order to increase the usability.

The copy LED key 702 turns on in a state in which copying is possible. When pressing of the copy LED key 702 is detected, the CPU 102 controls the scanner 113 and the printer 108 to perform a copy operation. When pressing of the job cancel key 703 is detected, the CPU 102 performs processing for cancelling a job that is currently being processed. The error LED 704 turns on if an error occurs in the image forming apparatus 10. Also, if the image forming apparatus 10 is in the first sleep state, control is performed by the CPU 102 such that, although power is supplied, the touch panel and the LEDs are turned off.

Operation Flow 1

Figure 8:
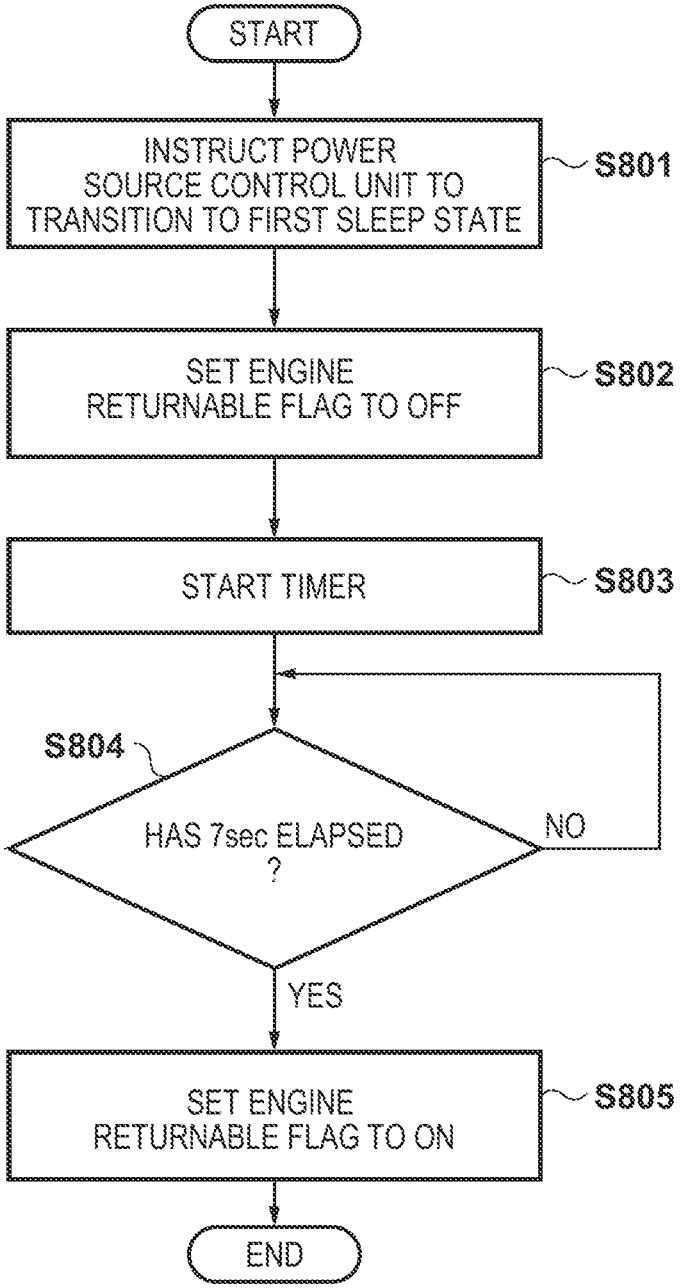
FIG. 8 is a diagram showing an operation flow when an image forming apparatus according to one embodiment transitions to the first sleep state from the standby state.

Next, a processing procedure used when the image forming apparatus 10 according to the present embodiment transitions to the first sleep state from the standby state will be described with reference to FIG. 8. Processing, which will be described below, is realized by, for example, the CPU 102 loading a control program stored in the ROM 107 on the RAM 103 and executing the control program.

In step S801, the CPU 102 instructs the power source control unit 115 to transition to the first sleep state, using the control signal P. In the present embodiment, transitioning to the first sleep state after a certain time period has elapsed from when the image forming apparatus 10 transitioned to the second sleep state, and transitioning to the first sleep state through a user operation are examples of an opportunity for the image forming apparatus 10 to transition to the first sleep state. The image forming apparatus 10 may transition to the first sleep state through a user operation under the condition where a predetermined input is accepted via the operation unit 105.

Next, the CPU 102 turns OFF an engine returnable flag in step S802. The engine returnable flag is a value stored in the RAM 103, and holds either value (for example, 0 or 1) indicating ON or OFF. The engine returnable flag is a value indicating whether the facsimile 110, the printer 108, and the scanner 113 can transition to the standby state. This flag is provided because some devices cannot return to the standby state for a certain time period (corresponding to a restriction time period) after the image forming apparatus 10 has transitioned to the first sleep state, due to restrictions on a control of the power of the second power supply unit 203. That is, a timing when the devices in the second power source system can transition to the standby state after transitioning to the sleep state is later, compared to the devices in the first power source system. Thus, if LED keys and the like are collectively turned on when a device in the first power source system transitions to the standby state, there is also a possibility that a device in the second power source system has not transitioned to the standby state, resulting in inconsistencies. In view of this, control is performed utilizing the engine returnable flag in order to resolve such inconsistencies. Herein, a restriction time period is set to 7 seconds as an example.

Next, in step S803, the CPU 102 starts a tinier for counting the above-described restriction time period. Next, the CPU 102 determines, in step S804, whether or not 7 seconds has elapsed, and if 7 seconds has elapsed, the processing proceeds to step S805. More specifically, the CPU 102 determines that a predetermined time period of 7 seconds has elapsed, due to the interrupt timer 114 having expired and an interruption occurring. In step S805, the CPU 102 sets the engine returnable flag to ON, and ends the processing. In this manner, when the engine returnable flag is set to ON, it is indicated that devices in the second power source system can transition to the standby state. Note that, although a control to determine whether or not devices in the second power source system can transition to the standby state using the engine returnable flag will be described in the present embodiment, it is not intended to limit the present invention to a control of this flag. That is, the present invention can be applied to any control as long as whether or not devices in the second power source system can transition to the standby state can be determined.

Operation Flow 2

Figure 9:
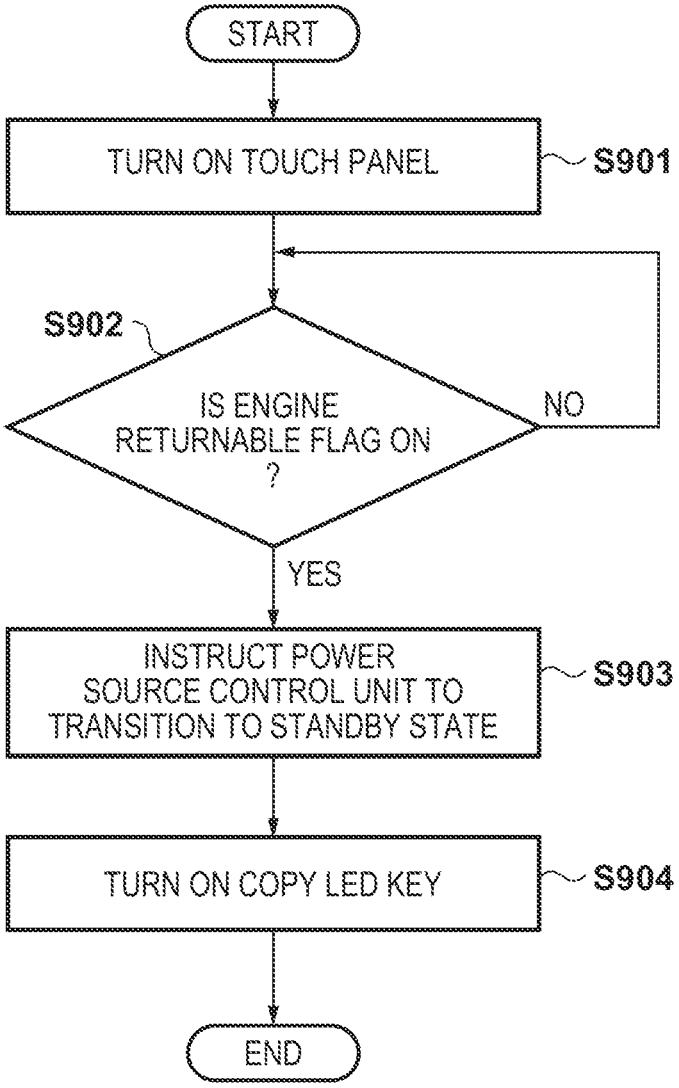
FIG. 9 is a diagram showing an operation flow when an image forming apparatus according to one embodiment transitions to the standby state from the first sleep state.

Next, a processing procedure used when the image forming apparatus 10 according to the present embodiment transitions to the standby state from the first sleep state will be described with reference to FIG. 9. Processing, which will be described below, is realized by the CPU 102 loading a control program stored in the ROM 107 on the RAM 103 and executing the control program.

In step S901, the CPU 102 turns on the touch panel 701 of the operation unit 105. As described above, when the CPU 102 accepts an input from the operation unit I/F 104 and the network I/F 106 in the first sleep state, the CPU 102 first turns on the touch panel 701 in order to transition to the standby state. Next, in step S902, the CPU 102 checks the value of the engine returnable flag controlled using the flow shown in FIG. 8. Herein, if the value of the engine returnable flag is ON, the processing proceeds to step S903, and the CPU 102 instructs the power source control unit 115 to transition to the standby state using the control signal P. That is, the CPU 102 waits until devices in the first power source system and devices in the second power source system can return to the standby state.

Next, in step S904, the CPU 102 turns on the copy LED key 702 of the operation unit 105, and ends the processing. Because of the control illustrated in this flow, in a state before the CPU 102 turns on the copy LED key 702 of the operation unit 105, the touch panel 701 is ON, while the copy LED key 702 and the error LED 704 are OFF. Also, in a state after the CPU 102 turns off the copy LED key 702 of the operation unit 105, the touch panel 701 and the copy LED key 702 are ON, while the error LED 704 is OFF.

Even if the value of the engine returnable flag is OFF, operations such as changing of settings by operating the touch panel 701 are possible because the operation unit 105, the CPU 102, the ROM 107, and the RAM 103 are operating. On the other hand, with regard to a copy operation executed by pressing the copy LED key 702, if the value of the engine returnable flag is OFF, the copy operation is not possible because power is not supplied to the printer 108 and the scanner 113. Thus, in the present embodiment, the operation unit 105 is controlled as described above, and the state of the image forming apparatus 10 and the ON/OFF state of each of the switches of the operation unit 105 are coordinated with each other.

As described above, the printing apparatus according to the present embodiment includes a standby state and a power saving state in which power consumption is lower than in the standby state. Also, this printing apparatus includes a CPU (system controller) configured to integrally control the apparatus, a plurality of engines for providing functions of the apparatus, and a power source control unit configured to control power supply to the CPU and the plurality of engines in accordance with the standby state and the power saving state. Also, when the power source control unit causes the apparatus to transition to the standby state from the power saving state, the power source control unit controls power in the standby state after it is confirmed that the plurality of engines can return to the standby state. Accordingly, according to the present embodiment, it is possible to provide a user interface that suitably indicates unfeasible operations even if the system controller and engines return from the sleep state under different conditions.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-194457 filed on Oct. 15, 2018, which is hereby incorporated by reference herein in its entirety.

What is claimed is:

1. A printing apparatus including a print engine and that is able to shift to a power saving state in which power to all or part of the print engine is stopped, the printing apparatus comprising:

a display;

a light emitter relating to a print function; and a power source control unit that turns on and turns off the display, and turns on and turns off the light emitter, wherein, when the printing apparatus returns from the power saving state, the power source control unit turns on the display, and then turns on the light emitter after a predetermined time period has elapsed since the printing apparatus shifts to the power saving state.

2. The printing apparatus according to claim 1, further comprising:

timer that starts counting for the predetermined time period, wherein the power source control unit turns on the light emitter after the timer has counted the predetermined time period.

3. The printing apparatus according to claim 2, wherein power is supplied from a battery to the timer, regardless of a power state of the printing apparatus.

4. The printing apparatus according to claim 2, wherein the printing apparatus is able to shift to another power saving state in which power consumption is lower than in the power saving state, and the printing apparatus further comprising a control unit that sets, when the printing apparatus shifts to the power saving state, a flag to OFF and cause the timer to start counting the predetermined time period, and set, when the timer has counted the predetermined time period, the flag to ON.

5. The printing apparatus according to claim 4, comprising:

an operation unit that includes at least a print start key, the light emitter and the display.

6. The printing apparatus according to claim 4, wherein the light emitter is provided in the print start key.

7. The printing apparatus according to claim 4, further comprising a scanner engine, wherein the print start key is a copy start key.

8. The printing apparatus according to claim 1, further comprising;

at least one of a scanner engine and a facsimile engine.

9. The printing apparatus according to claim 1, wherein the power source control unit supplies power to the all or part of the print engine after the predetermined time period has elapsed since the printing apparatus shifts to the power saving state.

10. The printing apparatus according to claim 9, wherein, when the printing apparatus returns from the power saving state after the predetermined time period has elapsed since the printing apparatus shifts to the power saving state, the power source control unit turns on the display and the light emitter.

11. The printing apparatus according to claim 1, wherein, when the printing apparatus returns from the power saving state before the predetermined time period has elapsed since the printing apparatus shifts to the power saving state, the power source control unit turns on the display, and then turns on the light emitter after the predetermined time period has elapsed since the printing apparatus shifts to the power saving state.

12. A method for controlling a printing apparatus including a print engine and that is able to shift to a power saving state in which power to all or part of the print engine is stopped, the printing apparatus including a display, a light emitter relating to a print function, and a power source control unit that turns on and turns off the display and turns on and turns off the light emitter, the method comprising:

turning on, when the printing apparatus returns from the power saving state, the display, and then turning on the light emitter after a predetermined time period has elapsed since the printing apparatus shifts to the power saving state.

13. A printing apparatus that is able to perform a print function and is able to shift to a power saving state in which power to all or part of devices that performs the print function is stopped, the printing apparatus comprising:

a light emitter relating to a print function; and a light emit controller that cause the light emitter to light, wherein, when the printing apparatus returns from the power saving state, the light emit controller does not cause the light emitter to light before a predetermined time period has elapsed since the printing apparatus shifts to the power saving state and causes the light emitter to light after the predetermined time period has elapsed since the printing apparatus shifts to the power saving state.

14. The printing apparatus according to claim 13, further comprising:

a timer that starts counting for the predetermined time period, wherein the light emit controller causes the light emitter to light after the timer has counted the predetermined time period.

15. The printing apparatus according to claim 14, wherein power is supplied from a battery to the timer, regardless of a power state of the printing apparatus.

16. The printing apparatus according to claim 13, wherein the printing apparatus is able to shift to another power saving state in which power consumption is lower than in the power saving state, and the printing apparatus further comprising a control unit that sets, when the printing apparatus shifts to the power saving state, a flag to OFF and cause the timer to start counting the predetermined time period, and set, when the timer has counted the predetermined time period, the flag to ON.

17. The printing apparatus according to claim 16, further comprising:

an operation unit that includes at least a print start key, the light emitter and the display.

18. The printing apparatus according to claim 17, wherein the light emitter is provided in the print start key.

19. The printing apparatus according to claim 16, further comprising;

at least one of a scanner engine and a facsimile engine.

20. The printing apparatus according to claim 13, wherein the power source control unit supplies power to the all or part of the print engine after the predetermined time period has elapsed since the printing apparatus shifts to the power saving state.

21. The printing apparatus according to claim 13, a display;

wherein, when the printing apparatus returns from the power saving state before the predetermined time period has elapsed since the printing apparatus shifts to the power saving state, the display is turned on, and the light emit controller causes the light emitter to light after the predetermined time period has elapsed since the printing apparatus shifts to the power saving state.

22. The printing apparatus according to claim 21, wherein, when the printing apparatus returns from the power saving state after the predetermined time period has elapsed since the printing apparatus shifts to the power saving state, the display is turned on and the light emit controller causes the light emitter to light.

* * * * *